US005358261A

United States Patent [19]

Cheng

[11] Patent Number: 5,358,261

[45] Date of Patent: Oct. 25, 1994

[54] METAL RACKET FRAME

[76] Inventor: Chin-Cheng Cheng, No.37-8, Lane 59, Nan Yang Rd., Pongyuan City, Taichung Hsien, Taiwan

[21] Appl. No.: 166,992

[22] Filed: Dec. 16, 1993

[51] Int. Cl.[5] ..... A63B 49/12

[52] U.S. Cl. ..... 273/73 H; 273/73 R

[58] Field of Search ..... 273/73 R, 73 C, 73 H, 273/73 K

[56] References Cited

U.S. PATENT DOCUMENTS 5,014,987 5/1991 Soong ..... 273/73 C
5,184,818 2/1993 Lo ..... 273/73 C X

FOREIGN PATENT DOCUMENTS 2114451 8/1983 United Kingdom ..... 273/73 H
2141033 12/1984 United Kingdom ..... 273/73 H

*Primary Examiner*—Vincent Millin
*Assistant Examiner*—Raleigh W. Chiu
*Attorney, Agent, or Firm*—Beveridge, DeGrandi, Weilacher & Young

[57] ABSTRACT

A metal racket frame includes an integrally formed hollow looped head portion with an inner peripheral wall and an outer peripheral wall that is thicker than the inner peripheral wall by about 0.1 mm to about 0.7 mm.

6 Claims, 4 Drawing Sheets

METAL RACKET FRAME

BACKGROUND OF THE INVENTION

1. Field of the Invention

The invention relates to a racket frame, more particularly to a metal racket frame which includes a hollow looped head portion with different outer and inner peripheral wall thicknesses.

2. Description of the Related Art

An ideal racket should be lightweight and is capable of providing a strong return force to a ball struck thereby. The outer appearance and the material of a metal racket frame are usually varied in order to meet these requirements.

FIG. 1 illustrates a conventional metal racket frame which includes a hollow looped head portion 1 that holds a string web 2. When a ball (not strikes the string web 2, the string web 2 applies an inward pulling force (F) on an outer peripheral wall of the head portion 1. The head portion 1 generates a counter force (E) to counteract the pulling force (F). In order to enable the head portion 1 to generate a stronger counter force (E) and further enable the racket to provide a strong return force to the ball which strikes the string web 2, the wall thickness of the head portion 1 is usually increased. An increase in the wall thickness of the head portion 1, however, results in a heavier racket. Such a racket cannot be used in international competitions because of existing weight restrictions for rackets. Furthermore, the use of heavy rackets can result in injuries to beginners.

SUMMARY OF THE INVENTION

Therefore, the objective of the present invention is to provide a metal racket frame which can overcome the above mentioned drawback that is common to the prior art.

More specifically, the objective of the present invention is to provide a metal racket frame which includes a hollow looped head portion with different outer and inner peripheral wall thicknesses.

According to this invention, a metal racket frame comprises an integrally formed hollow looped head portion which includes an inner peripheral wall with a first wall thickness that is within the range of about 0.1 mm to about 0.6 mm, and an outer peripheral wall with a second wall thickness that is within the range of about 0.3 mm to about 0.7 mm and that is thicker than the first wall thickness by about 0.1 mm to about 0.7 mm. The head portion has a generally oval-shaped cross-section and further includes a pair of curved peripheral side walls which interconnect two ends of the outer and inner peripheral walls. The peripheral side walls have wall thicknesses that decrease gradually from the outer peripheral wall to the inner peripheral wall.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
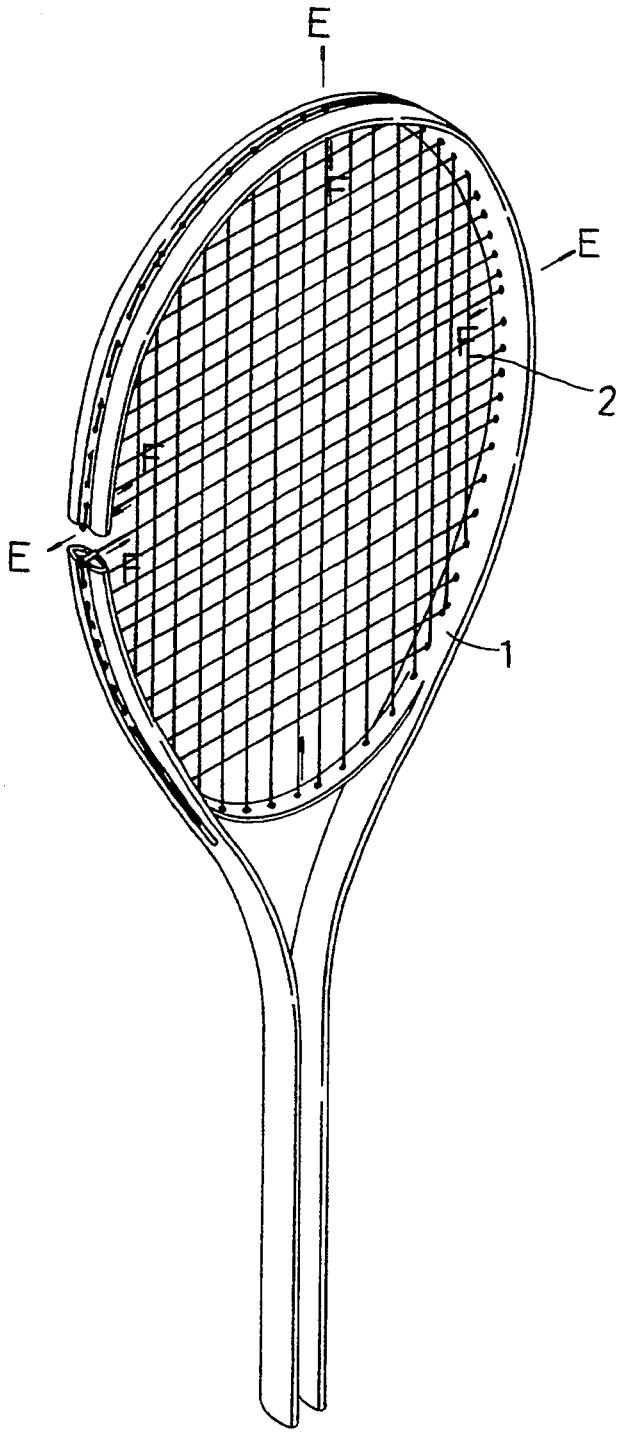
FIG. 1 PRIOR ART
FIG. 1 is a perspective view of a conventional metal racket frame.
Figure 2:
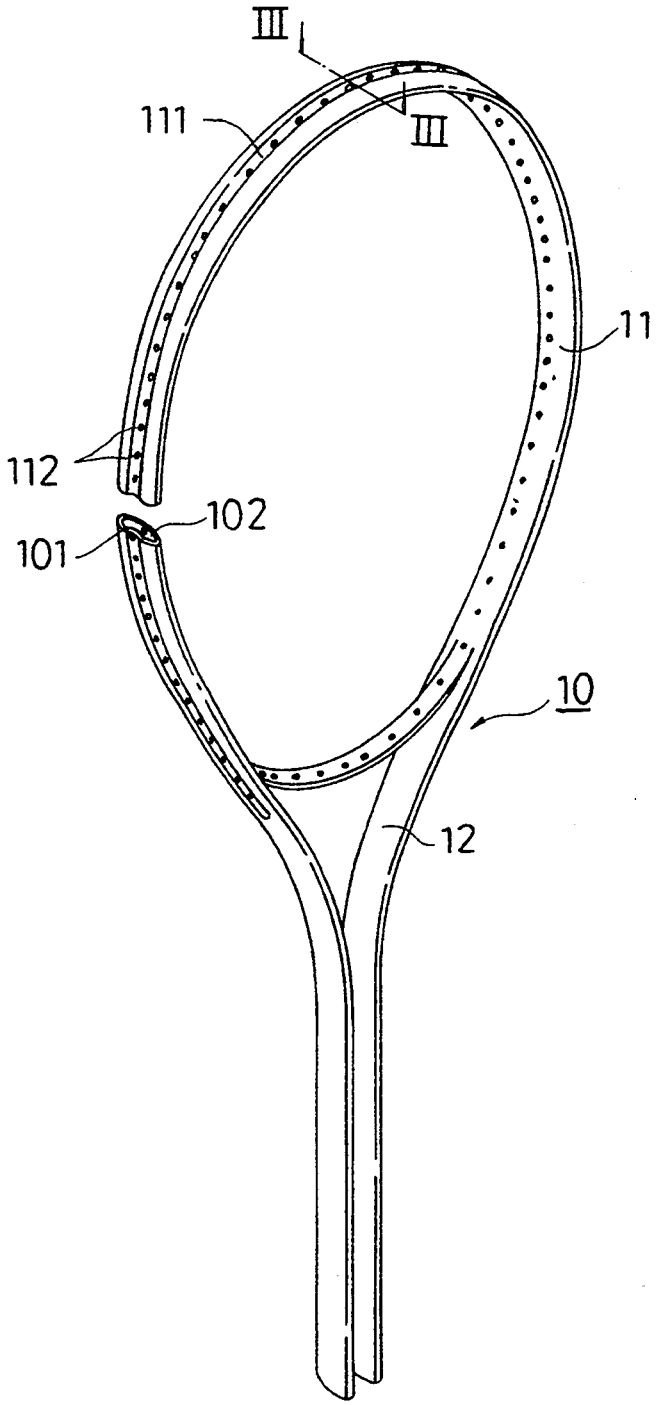
FIG. 2 is a perspective view of the preferred embodiment of a metal racket frame according to the present invention.

Referring to FIG. 2, the preferred embodiment of a metal racket frame 10 according to the present invention is formed integrally and is preferably made of aluminum. The racket frame 10 includes a hollow looped head portion 11 and a handle portion 12 which extends downwardly from the head portion 11.

Figure 3:
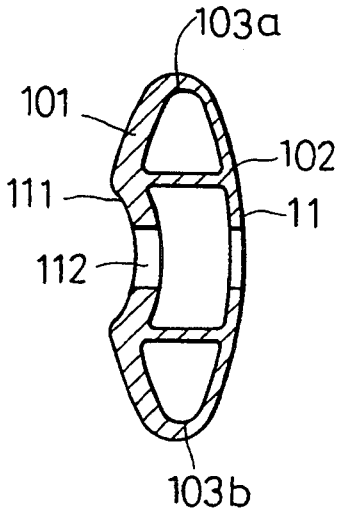
FIG. 3 is a cross-sectional view of the preferred embodiment taken along line III-III in FIG. 2.
Figure 4:
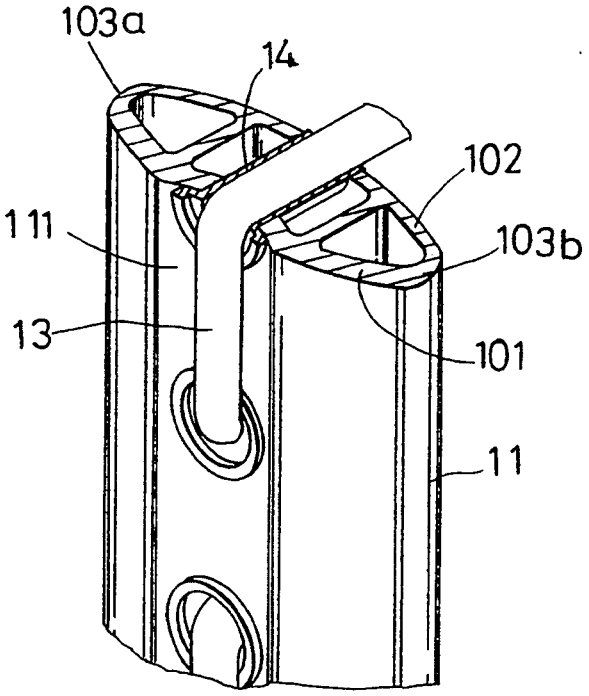
FIG. 4 is a fragmentary perspective view of a looped head portion of the preferred embodiment when a string web is held thereby.

Referring to FIGS. 3 and 4, the head portion 11 has a generally oval-shaped cross-section and includes outer and inner peripheral walls 101, 102 with different wall thicknesses. The outer peripheral wall 101 is thicker than the inner peripheral wall 102 and has a central portion that is indented so as to form a peripheral string receiving groove 111. The outer peripheral wall 101 preferably has a wall thickness within the range of about 0.3 mm to about 0.7 mm, while the inner peripheral wall 102 preferably has a wall thickness within the range of about 0.1 mm to about 0.6 mm. The difference in the wall thicknesses of the outer and inner peripheral walls 101, 102 is preferably within the range of 0.1 mm to 0.7 mm. The head portion 11 further includes a pair of curved peripheral side walls (103*a*, 103*b*) which interconnect two ends of the outer and inner peripheral walls 101, 102. The wall thicknesses of the side walls (103*a*, 103*b*) decrease gradually from the outer peripheral wall 101 to the inner peripheral wall 102. A plurality of string holes 112 are formed through the outer peripheral wall 101 at the string receiving groove 111 and through the inner peripheral wall 101. A tubular string guide 14 is provided in each of the string holes 112 and serves to prevent direct contact between the racket string 13 and the racket frame 10 to prevent damage to the racket string 13.

Figure 5B:
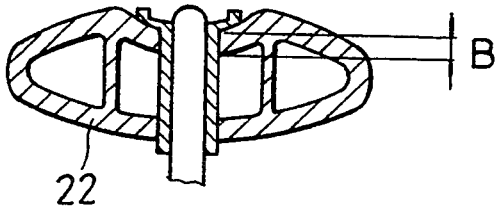
FIG. 5B PRIOR ART
FIGS. 5A, 5B and 5C are cross-sectional views which illustrate the differences between the preferred embodiment and two conventional metal racket frames.
Figure 5A:
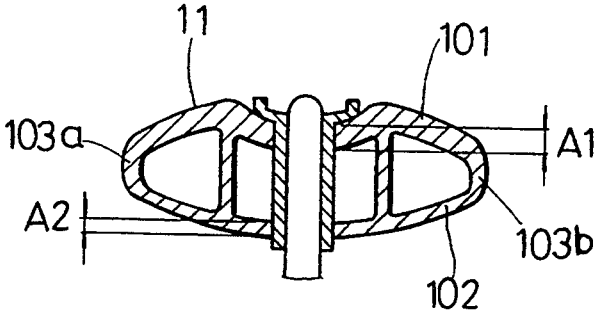

Referring to FIG. 5A, in the following illustrative example, the outer peripheral wall 101 has a wall thickness (A1) of about 0.8 mm, while the inner peripheral wall 102 has a wall thickness (A2) of about 0.4 mm. Thus, the average wall thickness of the head portion 11 is about 0.6 mm. FIG. 5B is a cross-sectional view of the head portion 22 of a conventional metal racket frame. The head portion 22 has a constant wall thickness (B) of about 0.6 mm. The weights of the metal racket frames shown in FIGS. 5A and 5B are thus approximately equal. However, since the outer peripheral wall 101 is thicker than the peripheral wall of the head portion 22, the preferred embodiment is capable of generating a stronger counter force and a stronger return force to a ball which strikes the string web that is held by the head portion 11.

Figure 5C:
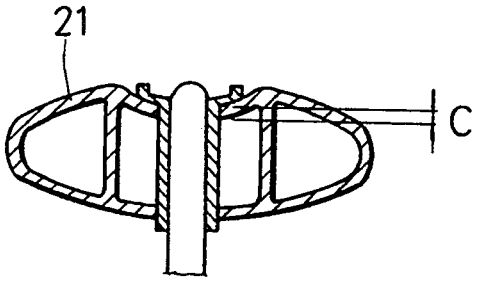
FIG. 5C PRIOR ART

FIG. 5C is a cross-sectional view of the head portion 21 of another conventional metal racket frame. The head portion 21 has a constant wall thickness (C) of about 0.8 mm. While the counter force that can be generated by the head portion 21 is substantially similar to that generated by the preferred embodiment, the metal racket frame shown in FIG. 5C is heavier than the preferred embodiment.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A metal racket frame comprising an integrally formed hollow looped head portion which includes an inner peripheral wall with a first wall thickness and an outer peripheral wall with a second wall thickness that is thicker than said first wall thickness by about 0.1 mm to about 0.7 mm.

2. The metal racket frame as claimed in claim 1, wherein said head portion is made of aluminum.

3. The metal racket frame as claimed in claim 1, wherein said outer peripheral wall has a central portion that is indented so as to form a peripheral string receiving groove, said head portion being formed with a plurality of string holes through said outer peripheral wall at said string receiving groove and through said inner peripheral wall.

4. The metal racket frame as claimed in claim 1, wherein said first wall thickness is within the range of about 0.1 mm to about 0.6 mm, and said second wall thickness is within the range of about 0.3 mm to about 0.7 mm.

5. The metal racket frame as claimed in claim 1, wherein said head portion has a generally oval-shaped cross-section.

6. The metal racket frame as claimed in claim 5, wherein said head portion further includes a pair of curved peripheral side walls which interconnect two ends of said outer and inner peripheral walls, said peripheral side walls having wall thicknesses that decrease gradually from said outer peripheral wall to said inner peripheral wall.

* * * * *